United States Patent [19]

Delgrange et al.

[11] Patent Number: 4,775,860

[45] Date of Patent: Oct. 4, 1988

[54] CONTROL CIRCUIT FOR AN ALTERNATING TYPE PLASMA DISPLAY PANEL

[75] Inventors: Louis Delgrange, St. Egreve; Michel Specty, Grenoble; Francoise Vialettes, St. Egreve, all of France

[73] Assignee: Thomson-CSF, Paris, France

[21] Appl. No.: 833,735

[22] Filed: Feb. 25, 1986

[30] Foreign Application Priority Data

Mar. 5, 1985 [FR] France ..... 85 03227

[51] Int. Cl.[4] ..... G09G 3/28

[52] U.S. Cl. ..... 340/776; 340/777; 340/811; 315/169.4

[58] Field of Search ..... 340/776, 777, 778, 805, 340/718, 719, 775, 771, 799, 811; 315/169.4

[56] References Cited

U.S. PATENT DOCUMENTS

| | | | |
|---|---|---|---|
| 3,973,253 | 8/1976 | Criscimagna et al. | 340/778 |
| 3,993,990 | 11/1976 | Miller et al. | 340/776 |
| 4,024,529 | 5/1977 | Sakai | 340/777 |
| 4,063,131 | 12/1977 | Miller | 340/776 |
| 4,087,805 | 5/1978 | Miller | 340/777 |
| 4,140,945 | 2/1979 | Trogdon | 340/776 |
| 4,415,892 | 11/1983 | Marentic | 340/776 |
| 4,492,957 | 1/1985 | Marentic | 340/777 |
| 4,575,721 | 3/1986 | Delgrange et al. | 340/776 |

FOREIGN PATENT DOCUMENTS 2547091 7/1985 France .

*Primary Examiner*—Marshall M. Curtis
*Assistant Examiner*—Mahmoud Fatahi-yar
*Attorney, Agent, or Firm*—Roland Plottel

[57] ABSTRACT

A control circuit is provided for an alternating type plasma display panel, comprising integrated circuits which are used for the first and second electrode arrays of the panel. In the first array, the integrated circuits participate in producing selective signals and transmit the reference voltage of the sustaining signals. In the second array, the integrated circuits participate in producing selective signals, and transmit the square wave voltage of the sustaining signals and their reference voltage is floating, that is to say that it follows the sustaining signals and, during production of the selective signals, it follows the lowest potential that is possible to apply to the electrodes. The integrated circuits are provided with logic circuits which receive a signal indicating whether the integrated circuit is used with the first or with the second electrode arrays, so that in the case of use with the first array the active electrodes are brought to the high level with respect to the non active electrode and in the case of use with the second array the non active electrodes are brought to the high level with respect to the active electrodes.

7 Claims, 2 Drawing Sheets

CONTROL CIRCUIT FOR AN ALTERNATING TYPE PLASMA DISPLAY PANEL

BACKGROUND OF THE INVENTION

1. Field of the Invention

The present invention relates to a control circuit for an alternating type plasma display panel.

2. Description of the Prior Art

Alternating type plasma display panels are well known in the prior art.

From the French patent applications No. 81 19941 and No. 83 09289, published under the French Pat. Nos. 2515402 (now U.S. Pat. No. 4,575,721) and 2547091 (now U.S. Pat. No. 4,636,784), in the name of THOMSON-CSF, control circuits are known for alternating type plasma display panels. These control circuits use integrated circuits which are different for each of the two electrode arrays of the panel. Thus, in FIG. 1 of the first patent mentioned, the integrated circuits connected to the electrodes $x_1$ to $x_n$ of the panel are designated by the reference X and the integrated circuits connected to the electrodes $y_1$ to $y_n$ by the reference Y.

Similarly, from the article in the review "Electronique et Applications Industrielles" No. 276, of the 15 Nov. 1979, pages 26 to 28, which is entitled; "Les circuits de commande d'afficheurs à panneau à plasma", integrated control circuits for plasma display panels are known, manufactured by Texas Instrument. It is a question of circuits SN 75500 N and SN 75501 N. The circuit SN 75500 N is intended for controlling the columns of the panel and circuit SN 75501 N is intended for controlling the lines of the panel. It is well known by specialists that the circuit SN 75501 N may be used for controlling lines and columns. But since this circuit is not designed for this use, that raises problems, of control signals in particular.

SUMMARY OF THE INVENTION

The present invention provides an integrated circuit designed for operating with the two electrode arrays of the panel, without complication of the controls and which therefore does not have the disadvantages of the Texas circuit SN 75501 N.

The present invention provides a control circuit for alternating plasma display panel, producing sustaining signals and selective signals for writing in and erasing the panel, these signals being applied between two electrodes belonging to a first and a second orthogonal electrode arrays, this control circuit comprising integrated circuits comprising more particularly a logic circuit defining the signal to be executed, its duration and the electrodes at which this signal will be active; wherein:

- the same integrated circuits are used for the first and second electrode arrays;
- in the first array, the integrated circuits participate in forming the selective signals and transmit the reference voltage of the sustaining signals;
- in the second array, the integrated circuits participate in forming the selective signals, transmit the square wave voltage of the sustaining signal and their reference voltage is floating, that is to say that it follows the sustaining signals and that, during formation of the selective signals, it follows the lowest potential that it is possible to apply to the electrodes;

- the logic circuits receive a signal indicating whether the integrated circuit is used in the first or second electrode array, so that in the case of use with the first network, the active electrodes are brought to the high level with respect to the non active electrodes and in the case of use with the second network, the non active electrodes are brought to the high level with respect to the active electrodes.

BRIEF DESCRIPTION OF THE DRAWINGS

Other objects, features and results of the invention will be clear from the following description, given by way of non limitative example and illustrated by the accompanying Figures which show.

In the different Figures, the same references designate the same elements but, for the sake of clarity, the sizes and proportions of the different elements are not respected.

DESCRIPTION OF THE PREFERRED EMBODIMENTS

Figure 1:
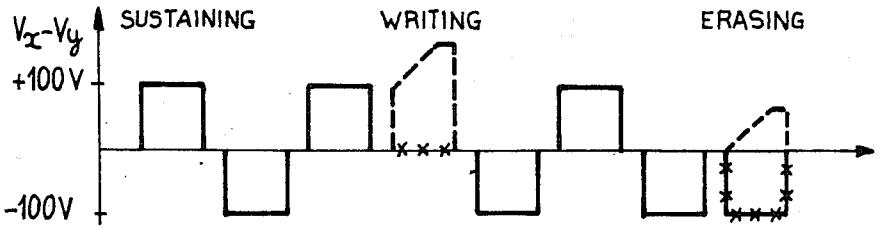
FIGS. 1 to 5, are panel control signals.

In FIG. 1, the sustaining, writing and erasing signals have been shown which are applied to the cells of the panel.

Plasma display panels comprise a large number of cells disposed in the form of a matrix. Each cell is formed by the gas space situated at the intersection of two electrodes belonging to the two orthogonal electrode arrays of the panel. Each cell is subjected to control signals $V_x-V_y$, shown in FIG. 1, and formed by the difference between voltages $V_x$ and $V_y$ applied to the two electrodes between which it is situated.

In so far as the writing and erasing signals are concerned, in FIG. 1, there have been shown with broken lines the signals $V_x-V_y$ which must be applied for writing in or erasing a cell and by asterisks have been shown the signals $V_x-V_y$ to be applied to the cells which are to be neither written nor erased. In FIGS. 2 to 5, these two methods of representation for the selective signals have been used again.

Figure 2:
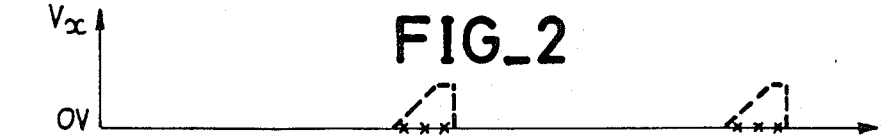
Figure 3:
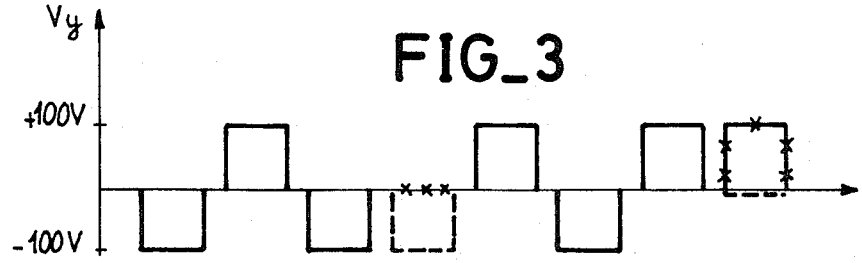

In FIGS. 2 and 3, the signals $V_x$ and $V_y$ have been shown which are applied to each of the electrode arrays so as to obtain the signals $V_x-V_y$ of FIG. 1.

In FIG. 2, it can be seen that the signals $V_x$ participate in forming the selective writing and erasing signals and transmit the reference voltage of the sustaining signals, that is to say of zero volt in FIG. 2.

In FIG. 3, it can be seen that the signals $V_y$ participate in forming the selective writing and erasing signals and transmit the square wave voltage of the sustaining signals.

The signals $V_x$ and $V_y$ could be inverted. The sustaining signals are not produced by the integrated circuits but by amplifiers external to the integrated circuits. The integrated circuits only transmit the sustaining signals.

In the case of signals $V_x$ and $V_y$ which are shown in FIGS. 2 and 3, it can be seen that the integrated circuits associated with one of the electrode arrays, these are the y electrodes, transmit the whole of the sustaining signals whereas the integrated circuits associated with the other electrode array, these are the x electrodes, transmit solely the reference voltage of the sustaining signals.

The integrated circuits of the invention are formed so as to be able to withstand a voltage of 100 volts. Thus, in order to obtain the signal $V_y$ which varies between −100 volts and 100 volts, a floating reference voltage $V_{ref}$ is used which follows the sustaining signals which also vary between −100 V and +100 V.

Figure 4:
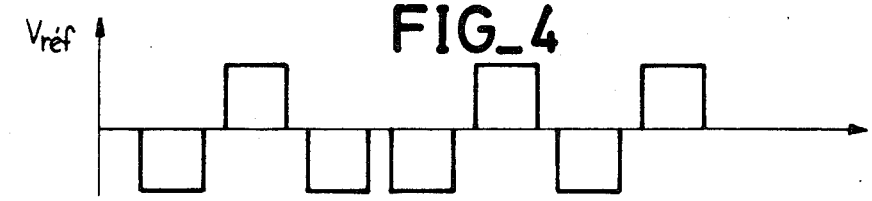

This floating reference voltage $V_{ref}$ is shown in FIG. 4. It can be seen, with respect to voltage $V_y$ of FIG. 3, that $V_{ref}$ follows the sustaining signals and that, during production of the selective signals, the voltage $V_{ref}$ follows the lowest potential that it is possible to apply to the electrodes.

Figure 5:
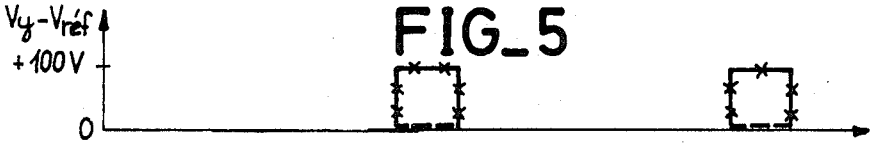

In FIG. 5, the voltage $V_y - V_{ref}$ has been shown which varies between 0 and 100 volts.

A comparison of FIGS. 2 and 5 shows that:

for the signal $V_x$, the active electrodes, that is to say those which are to be written or erased, are brought to +100 V above the level of the electrodes which are not modified;

whereas, for the signal $(V_y - V_{ref})$, it is the unmodified electrodes which are brought to +100 V above the active electrodes.

In the cited THOMSON-CSF patents, the control circuit for a plasma display panel comprises integrated circuits associated with amplifiers for producing sustaining signals and each integrated circuit comprises more particularly a logic circuit defining the signal to be executed, its duration and the electrodes on which this signal will be active.

In FIGS. 2 and 3 of the THOMSON-CSF Pat. No. 2 515 402 the general structure of the integrated circuits used has been shown.

In FIG. 2 of the French Pat. No. 2 547 091, the structure of a logic circuit has been shown forming part of an integrated circuit.

Each logic circuit is formed essentially of shift registers with series inputs and parallel outputs and a decoding and validation system. Thus, the data or logic addresses designating the active and non active electrodes are entered in series in the shift registers and are in parallel at the outputs of the registers which correspond respectively to the electrodes of the plasma display panel. An order defining the writing or erasure signal to be applied to the active electrodes then validates the parallel outputs of the registers which are fed to a low voltage/high voltage interface circuit.

According to the invention, to each logic circuit a signal is applied indicating on which electrode array the integrated circuit of which it forms part is used, so that:

in the case of use on one of the arrays, the active electrodes are brought to the high level with respect to the non active electrodes;

in the case of use on the other array, the non active electrodes are brought to the high level with respect to the active electrodes.

In accordance with the invention, logic circuits are formed which satisfy the following logic table:

| Strobe | Inv | Bit of the register | Output of the logic circuit |
|---|---|---|---|
| 1 | 1 | Indifferent state | high state |
| 1 | 0 | " | low state |
| 0 | 1 | 1 | low state |
| 0 | 1 | 0 | high state |
| 0 | 0 | 1 | high state |

-continued

| Strobe | Inv | Bit of the register | Output of the logic circuit |
|---|---|---|---|
| 0 | 0 | 0 | low state |

The "strobe" signal is an input of the logic circuit which by convention when it is at "1" indicates that an integrated circuit is not selected and when it is at "0" indicates that an integrated circuit is selected.

The "Inv" signal is the signal mentioned above which, by convention, when it is at "0" indicates that an integrated circuit is used on one of the electrode arrays, the x electrodes which receive $V_x$ in our example and which, when it is at "1", indicates that an integrated circuit is used on the other electrode array, the y electrodes which receive $V_y$ in our example.

A bit of the shift register is, by convention, at state 1 if it is desired to activate an electrode and at state 0 if it is not desired to activate an electrode.

Figure 6:
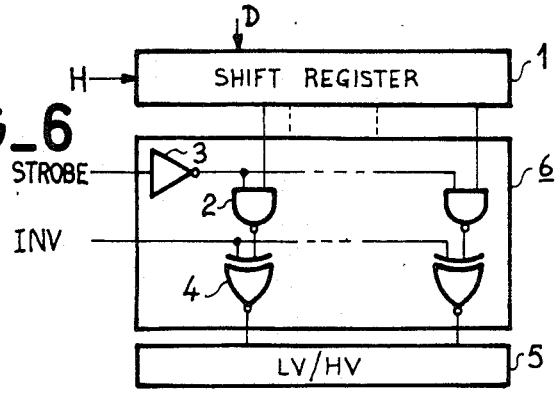
FIG. 6, a diagram of one embodiment of a logic circuit in accordance with the invention.

In FIG. 6, an embodiment of a logic circuit of the invention has been shown.

By the reference 1 is designated the shift register with series data D input and parallel outputs. This register receives a clock signal H. The acquisition of data in the register and application of an order to the electrodes of the panel are dissociated in time. The data D is entered in series in the register at the timing of the data acquisition clock H. A bit of the register is reserved for each electrode controlled.

This logic circuit conventionally comprises a decoding and validation circuit 6 which, during the duration of the signal to be executed, validates or not the outputs which feed towards the low voltage/high voltage interface, LV/HV, reference 5; this interface allows signals of an amplitude of 100 V to be applied directly to the electrodes.

Access to the panel is then provided by segments of points in lines and columns. Each point of these segments is defined as active or not by a bit of a shift register.

In the embodiment shown in FIG. 6, the decoding and validation system 6 comprises inverted AND circuits 2. Each circuit 2 is connected to one of the outputs of register 1 and to the output of an inverter 3 which receives this Strobe signal. This information is common to all the circuits 2 forming part of the same integrated circuit. An inverted exclusive OR circuit 4 receives for multiplexing the output of the circuit 2 and the signal Inv which is generally the same for the same integrated circuit.

The outputs of the inverted exclusive OR circuits 4 are connected to the low voltage/high voltage interface 5.

Depending on whether the integrated circuit is intended to produce a signal $V_x$ or $V_y$, the signal Inv may be permanently connected to the high level or to the low level.

If it is not desired to use a pin of each integrated circuit for inputting the information Inv, it is also possible to form two types of integrated circuits, for one of the types the input Inv will be connected internally to the high level and for the other type, the pin Inv will be connected internally to the low level. During the construction of the integrated circuits, it is only during the last masking level, which is the interconnection level, that a difference will exist.

It is also possible to input the signal Inv in series with the data D. A memory must then be provided for holding this signal at the input of circuits 2.

Different variants of the diagram of FIG. 6 may of course be contemplated which satisfy the logic table given above.

In the Pat. No. 2 547 091 already mentioned, it is explained how to operate a plasma display panel in the over printing mode or/and in the replacement mode.

The plasma display panel provided with a control circuit in accordance with the invention may operate in these two modes.

Figure 7:
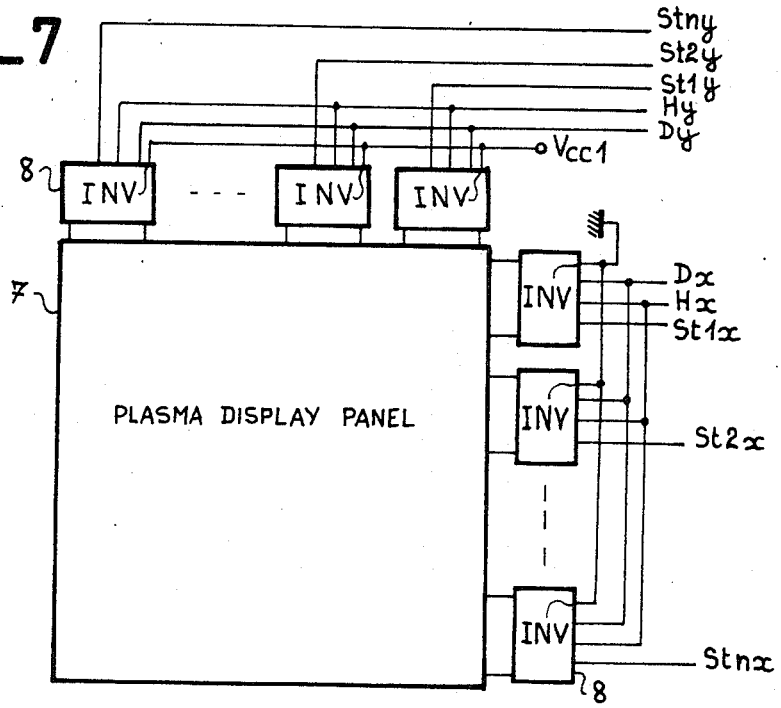
FIGS. 7 to 8, are two embodiments of the organization of a plasma display panel and the associated circuits.

In FIG. 7, a plasma display panel 7 has been shown schematically surrounded by integrated circuits 8 of its control circuit, the amplifiers associated with the integrated circuits have not been shown.

Each integrated circuit generally allows 32 electrodes to be controlled.

In FIG. 7, the integrated circuits controlling one of the electrode arrays have their Inv pin connected to the low level, that is to say to the ground of the device and the integrated circuits controlling the other electrode arrays have their Inv pin connected to the high level, to a voltage $V_{cc1}$.

The "strobe" signal is proper to each integrated circuit. In FIG. 7, the signals St1y, St2y . . . Stny and St1x, St2x . .. . Stnx have been shown.

The data $D_x$ and $D_y$ and the clock signals $H_x$ and $H_y$ use the same connection for the integrated circuits of the same network.

The panel shown in FIG. 7 operates in overprinting mode.

Figure 8:
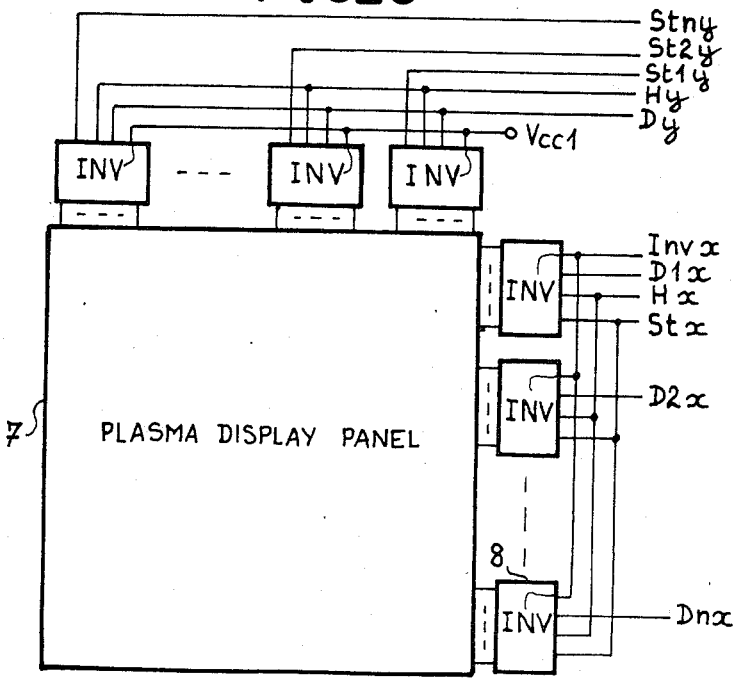

In FIG. 8, a plasma display panel 7 has been shown schematically surrounded by integrated circuits 8, in the case where it is desired to operate in the complete lines images replacement mode.

In so far as the vertically disposed integrated circuits are concerned which control the lines of the panel, the same connections are found as in the case of FIG. 7. The Inv inputs are connected to the high level to $V_{cc1}$. The "strobe" inputs $St_{1y}$, $St_{2y}$. . . $St_{ny}$ are proper to each integrated circuit, and the data $D_y$, and the clock signals $H_y$ are fed to a single connection for all the integrated circuits.

In so far as the horizontally disposed integrated circuits are concerned which control the columns of the panel, the following modifications are made:

the signal Inv is not permanently at the high level or at the low level. The signal Inv is a controlled logic signal;

each integrated circuit receives separately its data $D_{1x}$, $D_{2x}$ . . . $D_{nx}$, whereas the clock signal $H_x$ remains common to the integrated circuits connected to the same electrode array;

the strobe pins of all the integrated circuits receive the same signal $St_x$.

To effect image replacement as was explained in the above mentioned Pat. No. 2 547 091, the procedure is as follows:

the shift registers of the integrated circuits controlling the columns are loaded with the new image to be displayed;

simultaneously or not, the register of a circuit controlling the lines is loaded with the address of the line;

the complementary points of the points to be written in are erased by applying a high level signal Inv to the circuits controlling the columns at the same time as a strobe signal at 0 is applied;

the selected line is made simultaneously active by placing the strobe signal at 0;

immediately afterwards, the new image is written in by placing at 0 the Inv and strobe signals of the circuits controlling the columns at the same time as the selected line is activated.

Thus an image replacement of all the points of a line of a panel is performed in a simple manner.

This is particularly advantageous for video type image control.

Control of the panel may be provided with a small number of signals.

A single individual signal is required per integrated circuit: the data signal $D_{ix}$ for the circuits controlling the columns and the strobe signal for the circuits controlling the lines.

As was explained in the cited patent, closely related erasures and writing in may thus be performed.

What is claimed is:

1. A control circuit for an alternating type plasma display panel ensuring the producton of sustaining signals and selective signals for writing in and erasing the panel, these signals being applied between two electrodes belonging to a first and second orthogonal electrode arrays, this control circuit comprising at least one integrated circuit means comprising a corresponding number of logic circuits one for each integrated circuit means defining according to a received external signal the sustaining or selective signals to be executed, the duration of said signals to be executed and the electrodes on which the executed signals will be active, wherein, the same integrated circuit means is used for the first and second electrode arrays and comprises;

means for participating in the first array in producing the selective signals and for transmitting a reference voltage of the sustaining signals;

means for participating in the second array in the production of the selective signals and for transmitting a square wave voltage of the sustaining signals such that their reference voltage follows the sustaining signals and, during production of the selective signals, follows the lowest potential that it is possible to apply to the electrodes;

the logic circuits includes means for receiving the external signal indicating whether the integrated circuit is used in the first or the second electrode array, so that in the case of use in the first array, active electrodes are brought to a high level with respect to non active electrodes and in the case of use in the second array, non active electrodes are brought to a high level with respect to active electrodes.

2. The circuit as claimed in claim 1, wherein the high level is equal to +100 volts.

3. The circuit as claimed in claim 1, wherein the logic circuits satisfy the following logic table where:

a "strobe" signal is an input of each logic circuit which, when it is at "1" it indicates that the integrated circuit is not selected and when it is at "0" indicates that the integrated circuit is selected;

an "Inv" signal is the signal received by each logic circuit which, when it is at "0" indicates that the integrated circuit is used in the first electrode array and when it is at "1" indicates that the integrated circuit is used in the second electrode array;

a bit of a shift register forming part of each logic circuit is, at state "1" if it is desired to activate an electrode and at state "0" if it is not desired to activate an electrode;

| Strobe | Inv | Bit of the register | Output of the logic circuit |
|---|---|---|---|
| 1 | 1 | indifferent state | high state |
| 1 | 0 | " | low state |
| 0 | 1 | 1 | low state |
| 0 | 1 | 0 | high state |
| 0 | 0 | 1 | high state |
| 0 | 0 | 0 | low state |

4. The circuit as claimed in claim 3, wherein each logic circuit comprises a decoding and validation circuit with:

an inverted AND circuit having an input connected to one of the outputs of the register and to the output of an inverter which receives the strobe signal; and an inverted exclusive OR circuit which receives the output of an inverted AND circuit and the Inv signal.

5. The circuit as claimed in claim 3, wherein said Inv signal is applied to the logic circuits and multiplexed with the data which is entered in the register.

6. The circuit as claimed in claim 5, wherein each logic circuit comprises a decoding and validation circuit with:

an inverted AND circuit having an input connected to one of the outputs of the register and to the output of an inverter which receives the strobe signal;

an inverted exclusive OR circuit which receives the output of an inverted AND circuit and the Inv signal.

7. The circuit as claimed in claim 1, wherein each logic circuit comprises a decoding and validation circuit with:

an inverted AND circuit having an input connected to an output of the register and an output of an inverter which receives the strobe signal; and an inverted exclusive OR circuit which receives the output of an inverted AND circuit and the Inv signal.

* * * * *